United States Patent [19]

Kanno

[11] 4,106,768

[45] Aug. 15, 1978

[54] AMUSEMENT DEVICE

[75] Inventor: Hideyuki Kanno, Tokyo, Japan

[73] Assignee: Tomy Kogyo Co., Inc., Tokyo, Japan

[21] Appl. No.: 749,416

[22] Filed: Dec. 10, 1976

[30] Foreign Application Priority Data

Jun. 23, 1976 [JP] Japan ..... 51-83079[U]
Jul. 7, 1976 [JP] Japan ..... 51-91044

[51] Int. Cl.[2] ..... A63F 9/14; A63H 30/00

[52] U.S. Cl. ..... 273/1 M; 46/240; 74/422; 254/97

[58] Field of Search ..... 273/1 M; 46/240; 74/422; 254/95, 97; 194/9, DIG. 18; 33/1 M; 35/11 R

[56] References Cited

U.S. PATENT DOCUMENTS

| | | | |
|---|---|---|---|
| 1,858,020 | 5/1932 | Linke | 273/1 M X |
| 2,045,261 | 6/1936 | Clute | 254/95 |
| 2,679,302 | 5/1954 | Watson et al. | 194/DIG. 18 X |
| 2,709,220 | 5/1955 | Spector | 254/95 X |
| 3,253,364 | 5/1966 | Hinkson | 46/240 |
| 3,293,651 | 12/1966 | Gerber et al. | 33/1 M X |
| 3,338,576 | 8/1967 | Andriulis | 46/240 X |
| 3,605,334 | 9/1971 | Genin | 46/240 |
| 3,657,457 | 4/1972 | Poynter | 273/1 M X |
| 3,827,692 | 8/1974 | Morrison | 273/1 M X |

FOREIGN PATENT DOCUMENTS

| | | | |
|---|---|---|---|
| 1,055,766 | 10/1953 | France | 46/240 |

*Primary Examiner*—Paul E. Shapiro
*Attorney, Agent, or Firm*—Staas & Halsey

[57] ABSTRACT

An amusement device having a casing provided with a playing surface along which there is defined a path, a body for moving along the path, a magnetic mechanism within the casing on the opposite side of the playing surface from the body for attracting the body, a first control knob operatively connected to move the magnet in one direction, a second control knob operatively connected to move the magnet in a different direction, a timing mechanism operable by the user to select one of several predetermined time intervals to complete the playing of the game and which is provided with an audible sound signalling the end of the game, after which the first and second control knobs and their related mechanisms are rendered inoperative.

9 Claims, 13 Drawing Figures

FIG. 4
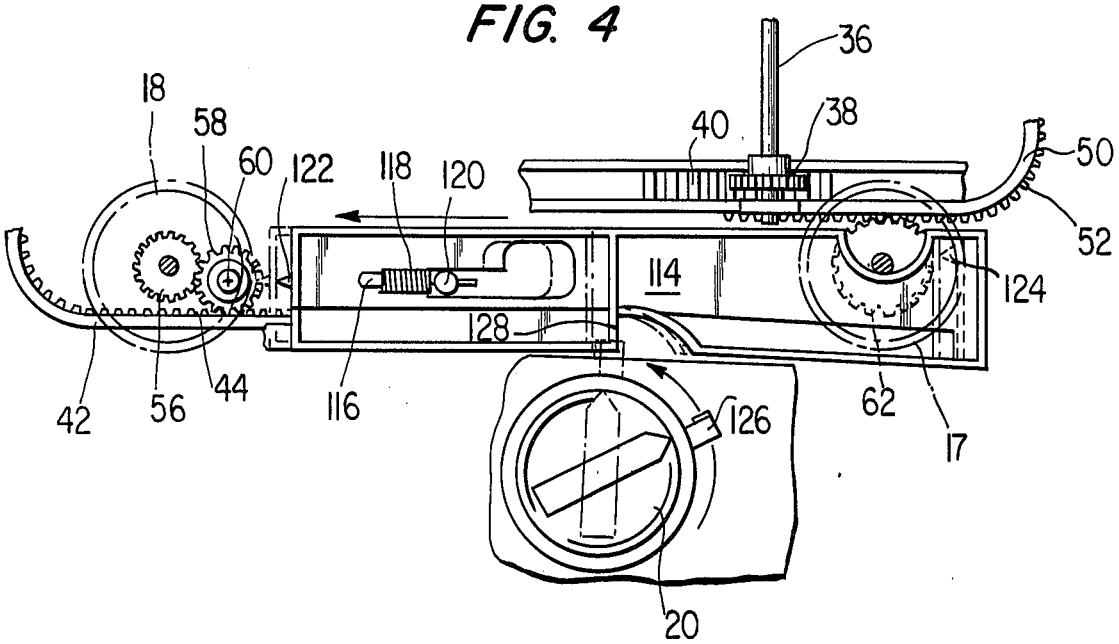
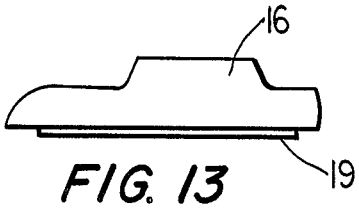
FIG. 13
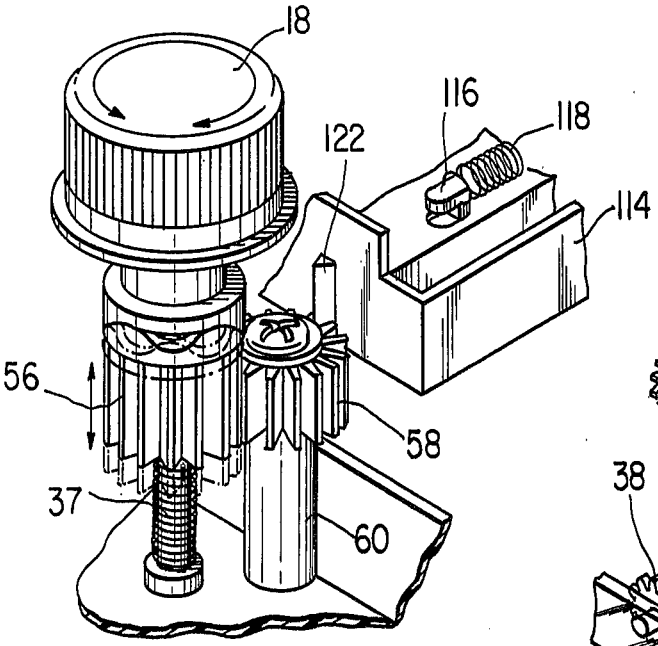
FIG. 12
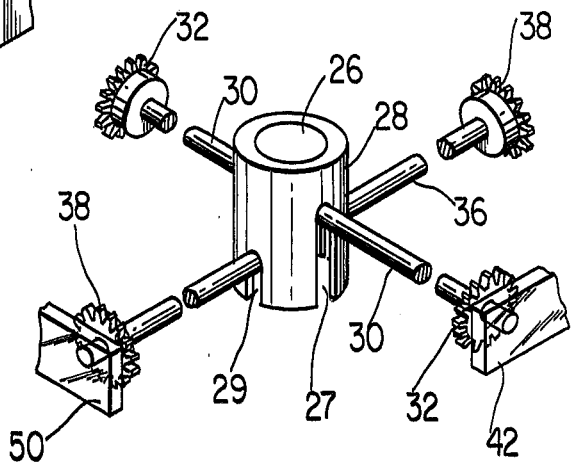
FIG. 3

FIG. 5
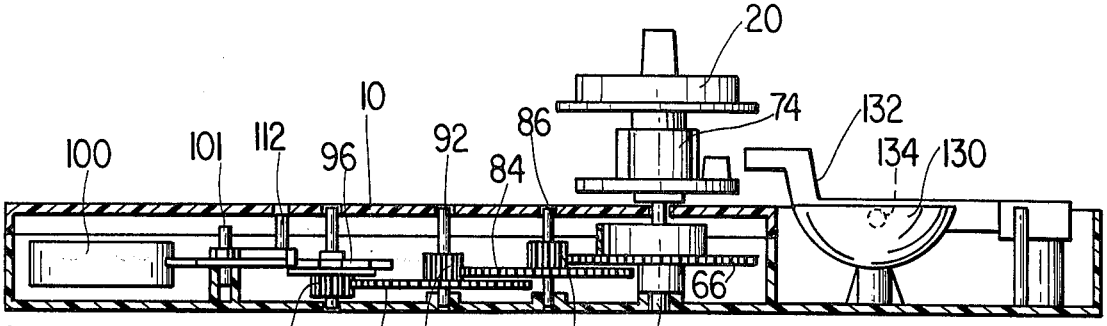
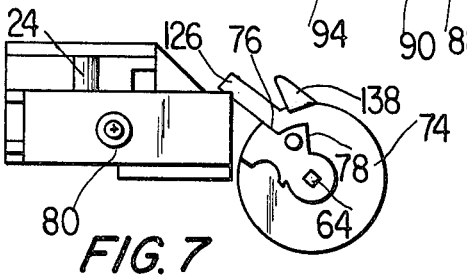
FIG. 7
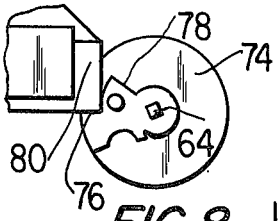
FIG. 8
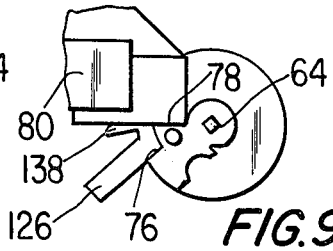
FIG. 9
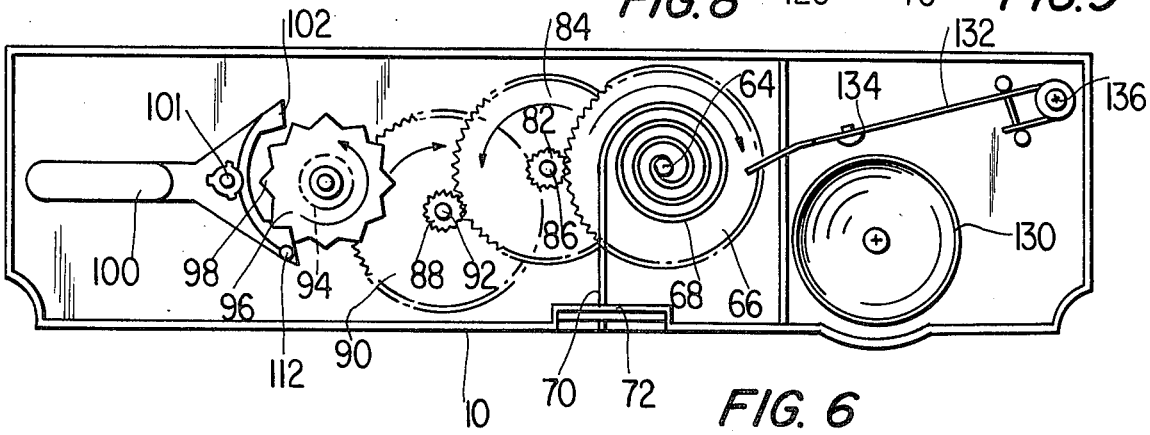
FIG. 6
FIG. 10
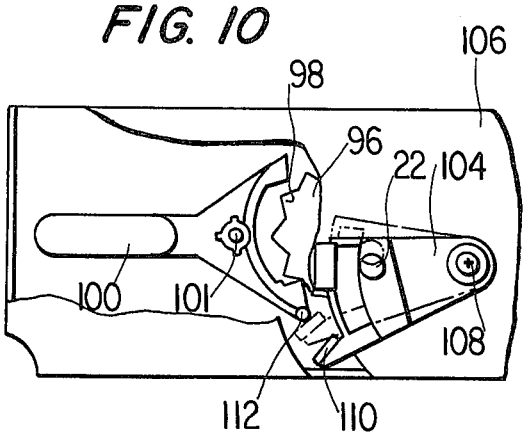
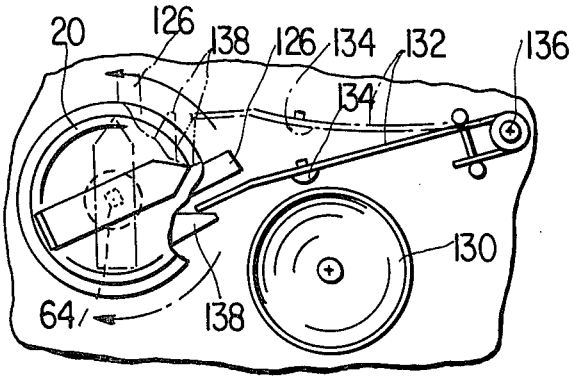
FIG. 11

AMUSEMENT DEVICE

BACKGROUND AND SUMMARY OF THE INVENTION

The present invention relates to the general class of amusement devices wherein a predetermined period of time is allotted for each player to accomplish an objective, in the present case the steering of a vehicle along a continuously changing path. The amusement device of the present invention is provided with a playing surface having a path along which a magnetically attractable body moves. There is provided a magnetic mechanism on the opposite side of the playing surface for moving the magnet longitudinally and transversely along the playing surface, the simultaneous operation of the control knobs resulting in a variety of oblique movements permitting the steering of the body along the path. A timing mechanism, operable by the user to initially set one of several possible playing times, signals the end of the so allotted time period and thereafter renders inoperable the control knobs.

BRIEF DESCRIPTION OF THE DRAWINGS

FIG. 3 is a perspective view illustrating the housing of the magnet and the cross arms secured thereto, and in particular the construction of the arms each of which terminates in a gear wheel which is mounted to travel within a continuous rack of teeth provided in the casing;

FIG. 4 is a enlarged plan view of a portion of the amusement device with the cover thereof removed, illustrating in particular the slide mechanism which is operable after termination of the game is signalled to prevent further movement of the control knobs which are responsible for moving the magnet so as to direct the toy vehicle along the path;

FIG. 5 is a front elevational view of the amusement device with a portion of the housing thereof removed so as to expose the interrelationship between the various gear mechanisms and the timing control knob;

FIG. 6 is a top plan view of a portion of the amusement device with the casing thereof removed so as to expose the gear train mechanism, and in particular the interaction between the unwinding of the timing control knob and a rotatably mounted arm which is sequentially moved in opposite directions to produce the clicking sound of a clock;

FIG. 7 is a top plan view of the blocking number and the plate which is located immediately below the timing control knob, and in particular the positioning of the blocking number so as to permit the timing control knob to be fully rotated to a position providing the maximum possible playing time;

FIG. 8 is a top plan view of a portion of the blocking mechanism and the plate, illustrating in particular movement of the blocking mechanism to an intermediate position preventing the plate from being fully rotated thus shortening the allotted playing time;

FIG. 9 is a top plan view of a portion of the blocking mechanism and the plate, illustrating in particular further movement of the blocking mechanism to a position still further decreasing the degree of rotation of the timing control knob to still further shorten the allotted playing time;

FIG. 10 is a top plan view of a portion of the amusement device with a portion of the housing thereof removed so as to expose the interaction between the elements which are responsible for terminating play at any desired time in response to movement of an operating button;

FIG. 11 is a top plan view of a portion of the amusement device, illustrating in particular the interaction between the rotating plate which is formed as a part of the timing control knob and the sound producing mechanism used to signal termination of the game;

FIG. 12 is a perspective view of one of the control knobs used to guide the vehicle along the path, and its gearing relationship to the slide mechanism which is moved into jamming relationship with respect to the gear mechanism at the end of the time allotted to complete play so as to prevent further movement of the vehicle; and FIG. 13 is a side elevational view of the vehicle showing the magnet positioned along the bottom thereof.

DESCRIPTION OF THE PREFERRED EMBODIMENT

Figure 1:
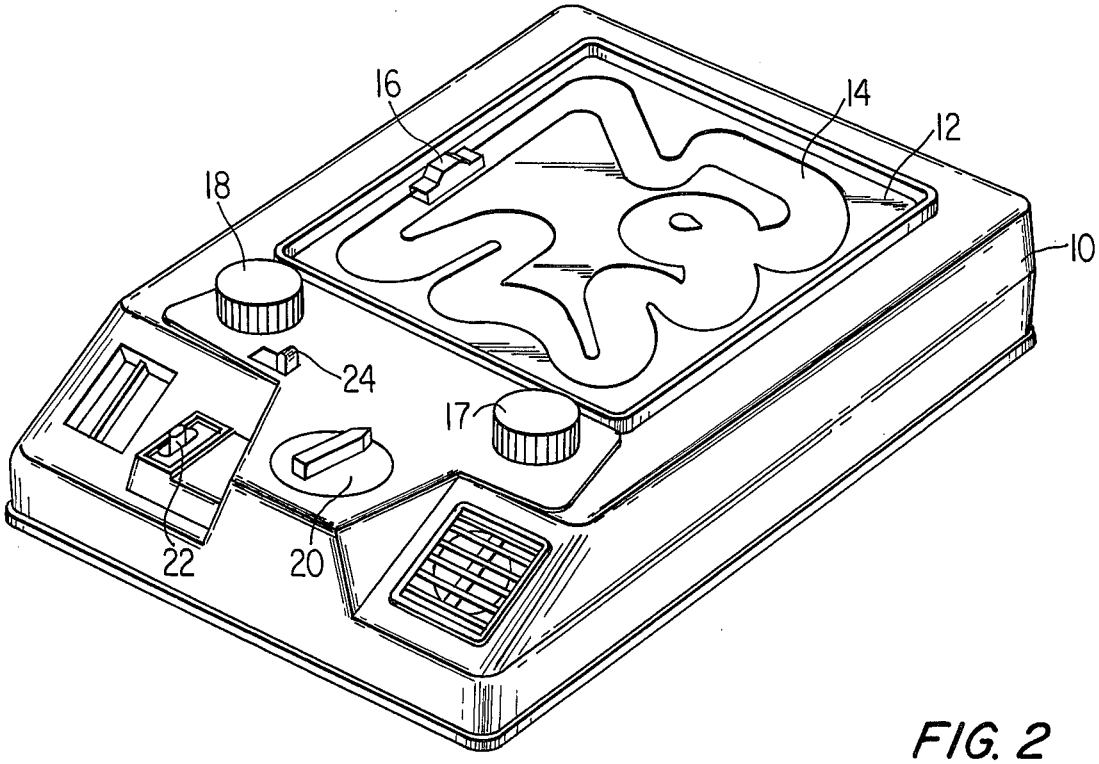
FIG. 1 is a perspective view of the game of the present invention, illustrating the playing surface within which there is defined the path for the vehicle and the numerous protruding operating controls, including the right and left knobs which are responsible for guiding the vehicle along the path, the timing mechanism which is manually rotated in one direction to begin the game, an "off-on" button for terminating operation when desired, and another button which is moved to vary the amount of time that is allocated to the player to maneuver the vehicle along the path.

The amusement device of the present invention, as illustrated in FIG. 1, consists of a casing 10 provided on the top thereof with a thin sheet 12, il.e., the playing surface, within which a racing path 14 is defined along which a body, i.e., the vehicle 16 provided on the bottom thereof with a magnet, races. Control knobs 17 and 18 protrude upwardly through openings provided in the casing 10. A timing control knob 20, "on-off" switch 22, and a button 24 for determining the length of time allotted each player also protrude upwardly through openings provided in the casing 10. The game is played by selecting the playing time to be allocated the player and then operating the control knobs 17 and 18 to steer the vehicle 16 around the path 14. Upon expiration of the time periods, an audible sound is produced signalling end of the game, after which it is impossible to continue operating the knobs 17 and 18.

Figure 2:
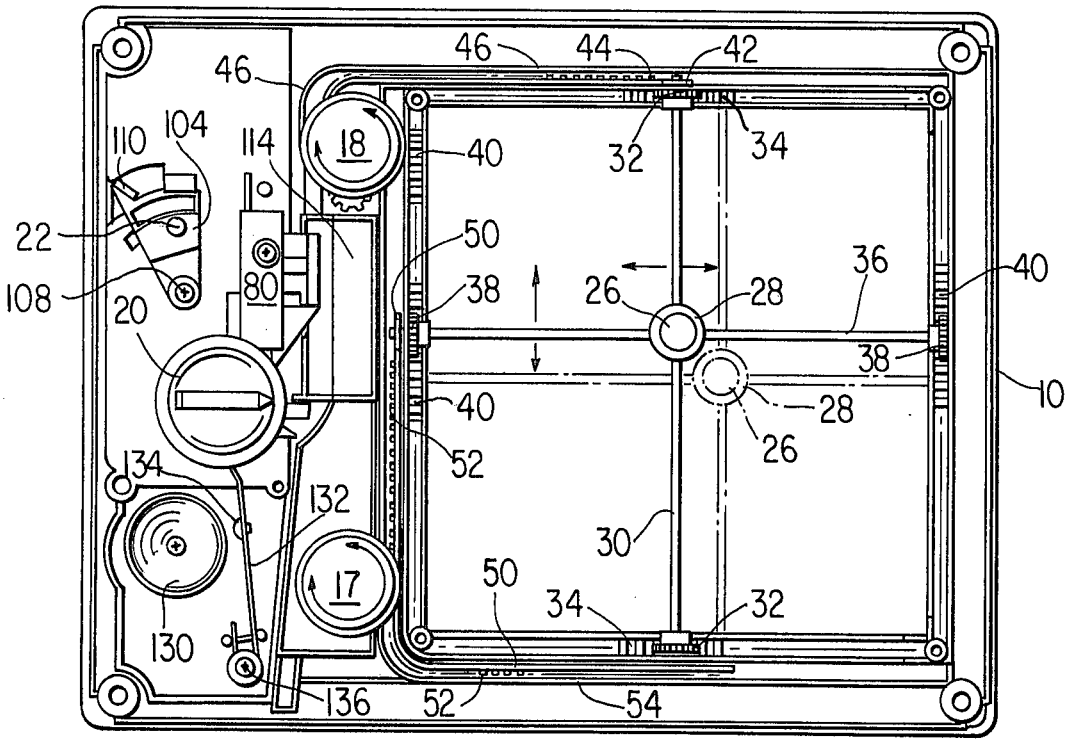
FIG. 2 is a top plan view of the amusement device with the cover removed to expose certain of the working mechanisms, and in particular the cross arms and magnetic mechanism secured thereto which are moved by operation of the left and right control knobs.

The mechanism for guiding the vehicle 16 along the path 14 is illustrated in FIGS. 2 and 3 wherein it will be apparent that within the casing 10 and below the sheet 12 there is provided a magnet 26 which is held within the top portion of the casing 28. An arm 30 extends through the casing 28 and terminates at each end thereof in a gear wheel 32 having teeth which mesh with a continuous rack of teeth 34 formed on the side of the casing 10. In similar manner, a rod 36 extends through the casing 28 and terminates at each end in a gear wheel 38 having teeth which mesh with a rack of teeth 40 provided on other of the sides of the casing 10. As seen in FIGS. 2 and 4, a flexible strip 42 provided with a continuous rack of teeth 44 is attached at one end to the shaft 30 and appropriated mounted within a channel 46 provided in the casing 10. In similar manner, a flexible strip 50 provided with a continuous rack of teeth 52 is positioned within a channel 54 provided in the casing 10, and one end of the flexible strip 50 is attached to the shaft 36. From FIGS. 4 and 12, it will be apparent that the control knob 18, which is mounted to the shaft 37 which is spring biased upwardly, is provided near the mid portion thereof with a gear 56 which meshes with a gear 58 which is appropriately mounted with fastener 60 to the casing 10 to rotate. In this manner, as the control knob 18 is manually rotated the gear wheel 56 rotates meshing with the gear 58 which rotates such that the teeth thereof mesh with the continuous rack of teeth 44 provided on the flexible strip 42 causing the gear wheels 32 and the rod 30 to move along the racks of teeth 34. In similar manner, the control knob 17 is provided near the mid portion thereof with a gear 62 having teeth which mesh with the teeth 52 of the flexible strip 50 such that rotation of the control knob 17 moves the flexible strip 50 within its channel 54, the result of which is to cause the gear wheels 38 and the rod 36 to move along the racks of teeth 40. From the foregoing, it will be apparent that it is possible by manually rotating the control knobs 17 and 18 to move the magnet 26 longitudinally and transversely of the playing surface 12 resulting in a composite oblique movement when the control knobs 17 and 18 are operated simultaneously. As seen in FIG. 3, the housing 28 is provided with slots 27 through which the rod 30 extends and slots 29 through which the rod 36 extends. Thus, the housing 28 and magnet 26 are free to slide along the rods 30 and 36 since the rod 30 is positioned above the rod 36. As previously explained, the vehicle 16 is provided on the bottom side thereof with a magnet 19, as illustrated in FIG. 13, thus causing the magnet 26 to attract the vehicle 16 through the thin strip 12 such that operation of the control knobs 17 and 18 permits the player to guide the vehicle 16 along the racing path 14.

As illustrated in FIG. 5, the timing control knob 20 is mounted to a shaft 64 which is appropriately journalled within the walls of the casing 10 for rotation. Affixed to the shaft 64 is a gear 66, and a coil spring 68 is wound around the shaft 64 having one end thereof attached to the shaft 64 and the other end 70 thereof attached to a plate 72 which, as illustrated in FIG. 6, is mounted to the walls of the casing 10. It will be apparent, therefore, that rotation of the knob 20 stores energy in the coil spring 68 as it becomes wound around the shaft 64, the purpose of which will be described hereinafter. A plate 74 is also mounted about the shaft 64, as seen in FIG. 5, and is provided with two separate cam surfaces 76 and 78, as illustrated in FIGS. 7–9.

Turning now to FIGS. 7–9, it will be apparent that a blocking member 80 is mounted for sliding movement with respect to the casing 10, and the button 24 illustrated in FIG. 1 is formed as a part of the blocking member 80 and extends upwardly through an opening provided in the top wall of the casing 10. Thus, by moving the button 24 sideways it is possible to orient the blocking member 80 in three separate positions as illustrated in FIGS. 7, 8 and 9, respectively. It will be apparent that when the button 24 is positioned all the way to the left, it is possible by rotating the timing control knob 20 clockwise to move the plate 74 associated therewith to the position illustrated in FIG. 7. Movement of the button 24 one step to the right results in movement of the blocking member 80 to the position illustrated in FIG. 8 wherein it will be apparent that the clockwise rotation of the plate 74 is terminated as the cam-like surface 76 strikes the blocking member 80. Movement of the button 24 all the way to the right results in moving the blocking member 80 to the position illustrated in FIG. 9 where it will be apparent that clockwise rotation of the plate 74 is stopped as the cam-like surface 78 strikes the blocking member 80. From the foregoing, it will be apparent that by movement of the button 24 between the three separate positions specified above, it is possible to terminate the manual rotation of the timing control knob 20 in the three separate positioned illustrated in FIGS. 7, 8 and 9, the result of which is to decrease in sequential manner the amount of time that it takes for the control knob 20 and the plate 74 associated therewith to unwind under the influence of the coiled spring 68, as explained hereinafter.

With reference to FIGS. 5 and 6, it can be seen that the gear 66 meshes with a gear 82 which is formed as an integral part of a larger gear 84 which is secured to a shaft 86 which is appropriately journalled within the walls of the casing 10. The gear 84 in similar manner meshes with a gear 88 which is formed as a part of a larger gear 90 which is mounted to a shaft 92 which is appropriately journalled for rotation to the walls of the casing 10. The gear 90 meshes with a gear 94 which is formed on the underneath side of a larger wheel 96 which is provided along the periphery thereof with a plurality of exaggerated teeth 98. An arm designated by the reference numeral 100 is attached to a shaft 101 which is appropriately journalled for rotation to the walls of the casing 10 such that the arm 100 is free to rotate about the axis of the shaft 102. The arm 100 is provided with fingers 102 which are spaced apart from each other a distance such that rotation of the wheel 96 causes the teeth 98 extending outwardly therefrom on opposite sides of the wheel 96 to sequentially strike opposite of the fingers 102 which causes a clicking sound while the arm continuously rotates back and forth. That is, as the wheel 96 rotates one of the teeth 98 on one side of the wheel 96 strikes one of the fingers 102 causing the arm 100 to rotate slightly in one direction and immediately thereafter one of the teeth 98 on the opposite side of the wheel 96 strikes the oppositely disposed finger 102 causing the arm 100 to rotate in the opposite direction, the cumulative effect thereof being a continuous process of engagement and disengagement between the rotating teeth 98 and the fingers 102 which is responsible for the causing the audible clicking sound.

There is also provided an arm 104 which is mounted to an inner wall 106 of the casing 10 to rotate about a shaft 108, as illustrated in FIG. 10. The arm 104 is provided with an abutment 110 which extends downwardly through an opening provided in the wall 106 into the vicinity of a post 112 which is provided on one of the fingers 102 of the arm 100. The button 22 illustrated in FIG. 1 extends upwardly from the arm 104, such that as the button 22 is moved forwardly the arm 104 rotates about the shaft 108 causing the abutment 110 to strike the post 112 urging the finger 102 associated therewith into jamming relationship against adjacent of the exaggerated teeth 98 formed on the wheel 96, the result of which is to prevent the wheel 96 from rotating. It will be apparent, therefore, that moving the button 22 forwardly stops rotation of the wheel 96 and the gears 66, 84 and 90. From the foregoing it will be apparent that after the control knob 20 is rotated clockwise to a starting position determined by the setting of the button 24, operation of the gearing mechanism in response to the uncoiling of the spring 68 causes the control knob 20 to rotate counterclockwise during which time a clicking sound is heard unless the button 22 is moved forwardly to stop the aforementioned movement.

Turning now to FIG. 4, the reference numeral 114 designates a slide mechanism which is appropriately mounted for movement along the casing 10. The slide mechanism 114 is provided with an abutment 116 around which one end of a spring 118 is attached, the other end of the spring 118 being secured to an abutment 120 which is formed as a part of the casing 10. Thus, the spring 118 normally urges the slide mechanism 114 to the right. The slide mechanism 114 is provided at one end thereof with a tooth 122, such that when the slide mechanism 114 is moved to the left the tooth 122 is jammed into position against adjacent of the teeth formed on the gear 58, the result of which is to prevent the control knob 18 from being operated. In similar manner, a tooth 124 is provided at the other end of the slide mechanism 114 on the underneath surface thereof, such that as the slide mechanism is moved to the left the tooth 124 jams adjacent of the teeth of the gear 62 precluding the other control knob 17 from being operated. Movement of the slide mechanism to the left, therefore, prevents the player from moving the control knobs 17 and 18 to guide the vehicle 16 along the path 14 after the game is terminated. As illustrated in FIGS. 4 and 9, the plate 74 which is mounted with the control knob 20 to the shaft 64 is provided with an outstanding arm 126 which during the unwinding of the coil spring 68 moves in a counterclockwise direction along with the control knob 20 until the end of the cycle when it engages the surface 128 which is positioned inwardly within the slide mechanism 114, it being apparent that further counterclockwise movement of the outstanding arm 126 against the surface 128 causes the slide mechanism 114 to move to the left aagainst the surface 128 causing the slide mechanism 114 to move to the left against the force of the spring 118 abruptly terminating the ability of the control knobs 17 and 18 to be operated.

As illustrated in FIGS. 2 and 11, there is also provided a sound producing mechanism in the form of a bell 130 appropriately mounted to the casing 10, and a flexible strip 132 provided with a striking element 134 which is mounted to the casing 10 with a fastener 136. It will also be apparent from FIGS. 9 and 11 that the plate 74 which is mounted along with the control knob 20 to the shaft 64 is provided with an outstanding abutment 138. Thus, as the timing control knob 20 reaches the end of its counterclockwise movement the abutment 138 engages the free end of the strip 132 moving same to the position illustrated in dotted lines in FIG. 11 until disengagement occurs, at which time the strip 132 moves backwardly to its original position at which time the element 134 strikes the bell 130 signalling the end of the game period.

I claim:

1. An amusement device, comprising:

a casing provided with a playing surface having a path;

a body for movement along said path and capable of being attracted by a magnet;

a magnet within said casing below said playing surface for attracting said body;

racks of teeth on said casing;

a housing within which said magnet is mounted and provided with passageway means;

first and second rods intersecting in the vicinity of said housing and passing through said passageway means such that said housing may move along each of said rods, and gears provided at the ends of said rods engaging said racks of teeth;

first and second control knobs corresponding to said first and second rods and provided with gears;

first and second flexible straps provided with racks of teeth and mounted to move within channels provided within said casing, said straps being attached to said first and second rods, and means operatively connecting said gears of said first and second control knobs and said racks of teeth of said flexible straps;

a third control knob mounted to said casing for rotation and provided with an abutment;

spring means associated with said third control knob for urging said knob to return to its original position after having been rotated to a different position; and a plate mounted for sliding movement in said casing between first and second positions and provided with a surface positioned in the path of travel of said abutment, striking members provided on said plate and positioned to engage said means operably connecting said gears of said first and second control knobs and said racks of teeth of said flexible straps to prevent movement of said first and second control knobs when said abutment of said third control knob strikes said surface of said plate moving said plate to said first position, and spring means normally urging said plate to said second position.

2. In an amusement device having a playing surface, a body for movement along the playing surface and capable of being attracted by a magnet, a magnet below the playing surface, and means for moving said magnet in different directions to attract and guide the body along the playing surface, the improvement comprising a control mechanism provided on a shaft that is mounted to rotate, spring means associated with said shaft such that as said control mechanism is manually rotated energy is stored in said spring means after which said control mechanism is caused to rotate in the opposite direction under the influence of said spring means, multiple cam means and an abutment provided on said control mechanism, a first member mounted for movement toward and away from said multiple cam means and having a surface for engagement with said multiple cam means for preventing further manual rotation of said control mechanism, the degree of movement of said surface of said first member determining which of said multiple cam means is engaged by said first member and thus the degree said control mechanism may be rotated, and a second member mounted for movement within the path of travel of said abutment of said control mechanism, and locking means provided on said second member for preventing operation of said means for moving said magnet when said abutment engages and moves said second member.

3. An amusement device as in claim 2, including manually operated means for terminating the rotation of said control mechanism in the opposite direction, as desired.

4. An amusement device as in claim 2, including a second abutment provided on said control mechanism, a bell, and a resiliently mounted striking element which when engaged by said second abutment is moved away from said bell ultimately being released from said second abutment to strike said bell.

5. An amusement device as in claim 2, wherein said means for moving said magnet comprises racks of teeth, a housing within which said magnet is mounted and provided with passageway means, first and second rods intersecting in the vicinity of said housing and passing through said passageway means such that said housing may move along each of said rods, and gears provided at the ends of said rods engaging said racks of teeth, first and second control knobs corresponding to said first and second rods provided with gears, and first and second flexible straps provided with racks of teeth and mounted to move within channels provided within said casing, said straps being attached to said first and second rods, and means operatively connecting said gears of said first and second control knobs and said racks of teeth of said flexible straps.

6. An amusement device as in claim 5, wherein said locking means provided on said second member comprises a wedge, and wherein said means operatively connecting said gear of said first control knob and said rack of teeth of said first flexible strap comprises gear means engaging said rack of teeth of said first flexible strap and said gear of said first control knob, said wedge of said second member preventing operation of said first control knob when moved into engagement with said gear means.

7. An amusement device, comprising:

a casing provided with a playing surface;

a body for movement along said playing surface and capable of being attracted by a magnet;

a magnet;

first and second rod means to which said magnet is mounted for movement below said playing surface;

first and second knobs provided with first and second gears;

first and second flexible straps provided with racks of teeth and attached to said first and second rod means;

a third gear operatively connected to said first gear and said rack of said first flexible strap such that the rotation of said first knob moves said first rod, said second gear engaging said rack of said second strap such that the rotation of said second knob moves said second rod;

a member provided with first and second elements and mounted for movement between a first position wherein said first and second elements engage said third and second gears, respectively, to render said knobs immovable, and a second position wherein said first and second elements are disengaged from said third and second gears, and means normally urging said member to said second position; and a control mechanism provided on a shaft that is mounted to rotate, spring means associated with said shaft such that as said control mechanism is manually rotated energy is stored in said spring means after which said control mechanism is caused to rotate in the opposite direction under the influence of said spring means, an abutment provided on said control mechanism and arranged to engage a portion of said member as said control mechanism rotates in said opposite direction to move said member to said first position against the force of said means urging said member to said second position.

8. An amusement device as in claim 7, further comprising a second member mounted for movement and cam means provided on said control mechanism such that the movement of said second member to different positions for engagement with said cam means determines how far said control mechanism may be turned.

9. An amusement device, comprising:

a body provided with a magnet;

a board provided with a path along one side thereof along which said body may travel;

a housing provided with openings positioned on the other side of said board, and a magnet mounted on said housing;

rods extending longitudinally and transversely across said other side of said board and passing through said openings provided in said housing;

gears affixed to the ends of said rods, and racks of teeth extending longitudinally and transversely across said other side of said board;

manually operable control means for independently and simultaneously moving said rods including a rotatably mounted control knob associated with each of said rods, a flexible rack of teeth associated with each of said control knobs and attached to the said rod associated therewith, and a gear mechanism associated with each of said control knobs engaging its said associated flexible rack of teeth;

timing means for terminating operation of said control knobs after a time interval has elapsed;

means for varying the duration of said time interval; and means for terminating and reactivating said timing means.

* * * * *